US010371439B2

(12) United States Patent
Marutani et al.

(10) Patent No.: US 10,371,439 B2
(45) Date of Patent: Aug. 6, 2019

(54) REFRIGERATOR AND REFRIGERATOR WATCHING SYSTEM

(71) Applicant: Toshiba Lifestyle Products & Services Corporation, Tokyo (JP)

(72) Inventors: Yuuki Marutani, Tokyo (JP); Kazuhiro Furuta, Tokyo (JP); Takuya Mashimo, Tokyo (JP)

(73) Assignee: TOSHIBA LIFESTYLE PRODUCTS & SERVICES CORPORATION, Tokyo (JP)

( * ) Notice: Subject to any disclaimer, the term of this patent is extended or adjusted under 35 U.S.C. 154(b) by 636 days.

(21) Appl. No.: 14/663,355

(22) Filed: Mar. 19, 2015

(65) Prior Publication Data

US 2015/0260450 A1 Sep. 17, 2015

Related U.S. Application Data

(63) Continuation of application No. PCT/JP2013/073799, filed on Sep. 4, 2013.

(30) Foreign Application Priority Data

Sep. 27, 2012 (JP) ..... 2012-214367

(51) Int. Cl.
*F25D 29/00* (2006.01)
*G08B 21/02* (2006.01)
(Continued)

(52) U.S. Cl.
CPC ..... *F25D 29/00* (2013.01); *G08B 21/02* (2013.01); *G08B 21/22* (2013.01); *G08B 25/10* (2013.01);
(Continued)

(58) Field of Classification Search
CPC ..... F25D 2700/02; F25D 2700/04; F25D 2700/14; F25B 2700/17; F25B 2700/171;
(Continued)

(56) References Cited

U.S. PATENT DOCUMENTS 5,894,275 A * 4/1999 Swingle ..... G08B 3/10 340/573.3
6,393,848 B2 * 5/2002 Roh ..... F25D 29/00 236/51
(Continued)

FOREIGN PATENT DOCUMENTS

CN 1424843 6/2003
CN 104634038 A * 5/2015 ..... F25D 11/00
(Continued)

OTHER PUBLICATIONS

Korean Office Action (with English language Translation) issued in KR 10-2015-7002501 dated Apr. 5, 2017.
(Continued)

*Primary Examiner* — Edward F Landrum
*Assistant Examiner* — Daniel C Comings
(74) *Attorney, Agent, or Firm* — DLA Piper LLP US

(57) ABSTRACT

A refrigerator includes an outside environment information obtaining unit including at least one of a sound obtaining unit configured to obtain outside environment information and an imaging unit configured to image an outside environment, the outside environment information obtaining unit being configured to obtain outside environment information which is capable of grasping an outside situation and a communication unit configured to communicate with an external device connected thereto via a network, thereby rendering the outside environment information obtained by the outside environment information obtaining unit referable at the external device side.

17 Claims, 8 Drawing Sheets

(51) Int. Cl.
*G08B 21/22* (2006.01)
*G08B 25/10* (2006.01)

(52) U.S. Cl.
CPC .... *F25D 2400/361* (2013.01); *F25D 2700/02* (2013.01); *F25D 2700/04* (2013.01); *F25D 2700/14* (2013.01)

(58) Field of Classification Search
CPC ..... F25B 2700/172; F25B 2700/173; F25B 2700/15; F25B 2700/151
USPC ..... 236/51
See application file for complete search history.

(56) References Cited

U.S. PATENT DOCUMENTS

| | | | | |
|---|---|---|---|---|
| 2002/0007486 | A1* | 1/2002 | Yun | F25D 29/00 725/26 |
| 2004/0216471 | A1 | 11/2004 | Kim | |
| 2010/0170289 | A1* | 7/2010 | Graziano | F25D 23/02 62/449 |
| 2011/0126555 | A1* | 6/2011 | Lee | F25D 29/00 62/56 |
| 2011/0190952 | A1* | 8/2011 | Goldstein | H02J 3/32 700/291 |

FOREIGN PATENT DOCUMENTS

| | | |
|---|---|---|
| JP | 2001-109969 | 4/2001 |
| JP | 2002-084989 | 3/2002 |
| JP | 2002-156181 | 5/2002 |
| JP | 2002-222010 | 8/2002 |
| JP | 2002-267337 | 9/2002 |
| JP | 2002-298260 | 10/2002 |
| JP | 2003-044960 | 2/2003 |
| JP | 2003-153868 | 5/2003 |
| JP | 2003-185315 | 7/2003 |
| JP | 2003-228784 | 8/2003 |
| JP | 2004-271174 | 9/2004 |
| JP | 2005-009695 | 1/2005 |
| JP | 2005-069540 | 3/2005 |
| JP | 2005-284535 | 10/2005 |
| JP | 2006-057906 | 3/2006 |
| JP | 2006-119984 | 5/2006 |
| JP | 2007-046833 | 2/2007 |
| JP | 2009-157758 | 7/2009 |
| JP | 2011-075268 | 4/2011 |
| JP | 2012-161173 | 8/2012 |
| KR | 10-2001-0113398 | 12/2001 |
| TW | 200617335 | 6/2006 |
| TW | 201217731 | 5/2012 |

OTHER PUBLICATIONS

Extended European Search Report issued in EP Application No. 13841973 dated Oct. 18, 2016.
English Language Abstract of JP 2003-044960 published on Feb. 14, 2003.
Korean Office Action (with English language Translation) issued in KR 10-2015-7002501 dated Oct. 14, 2016.
English Language Abstract and Translation of KR 10-2001-0113398 published on Dec. 28, 2001.
International Search Report issued in PCT/JP2013/073799 dated Nov. 26, 2013.
Written Opinion issued in PCT/JP2013/073799 dated Nov. 26, 2013.
Korean Office Action issued in KR 10-2015-7002501 dated Jan. 15, 2016 with English language translation.
Chinese Office Action issued in CN 201380049419.X dated Dec. 29, 2015 with English Language translation.
Japanese Office Action issued in JP 2012-214367 dated Jun. 28, 2016 with English language Translation.
English language Abstract and machine translation of JP 2005-009695 published on Jan. 13, 2005.
English language Abstract and machine translation of JP 2001-109969 published on Apr. 20, 2001.
English language Abstract and machine translation of JP 2006-057906 published on Mar. 2, 2006.
English language Abstract and machine translation of JP 2002-222010 published on Aug. 9, 2002.
English language Abstract and machine translation of JP 2012-161173 published on Aug. 23, 2012.
English language Abstract and machine translation of JP 2009-157758 published on Jul. 16, 2009.
English language Abstract and machine translation of JP 2002-267337 published on Sep. 18, 2002.
English language Abstract and machine translation of JP 2002-298260 published on Oct. 11, 2002.
English language Abstract and machine translation of JP 2006-119984 published on May 11, 2006.
English language Abstract and machine translation of JP 2003-228784 published on Aug. 15, 2003.
English language Abstract and machine translation of JP 2004-271174 published on Sep. 30, 2004.
English language Abstract of JP 2002-084989 published on Mar. 26, 2002.
English language Abstract and machine translation of JP 2003-185315 published on Jul. 3, 2003.
English language Abstract and machine translation of JP 2003-153868 published on May 27, 2003.
English language Abstract and machine translation of CN 1424843 published on Jun. 18, 2003.
English language Abstract and machine translation of JP 2007-046833 published on Feb. 22, 2007.
English language Abstract and machine translation of JP 2005-069540 published on Mar. 17, 2005.
English language Abstract and machine translation of JP 2002-156181 published on May 31, 2002.
English language Abstract and machine translation of JP 2011-075268 published on Apr. 14, 2011.
English language Abstract of TW 201217731 published on May 1, 2012.
Korean Office Action (with English language Translation) issued in KR 2015/7002501 dated Aug. 12, 2016.
English Language Abstract and English Language Translation of JP 2005-284535 published on Oct. 13, 2005.

* cited by examiner

REFRIGERATOR AND REFRIGERATOR WATCHING SYSTEM

CROSS-REFERENCE TO RELATED APPLICATIONS

This application is based upon and claims the benefit of priority from the prior Japanese Patent Application No. 2012-214367 filed on Sep. 27, 2012 and the prior PCT International Application No. PCT/JP2013/73799 filed on Sep. 4, 2013, the entire contents of both of which are incorporated herein by reference.

FIELD

Embodiments described herein relate to a refrigerator.

BACKGROUND

A system has conventionally been proposed which keeps watching, for example, a single-living old man from a remote location.

However, when the watching system is configured of equipment a person wears or carries on him/her, an object person normally needs to wear or carry the equipment on him/her with the result that the watching system has little practical application. Further, a communication means is required in order that watching from a remote location may be realized. However, when the equipment is transportable, the object person is normally required to take account of remaining battery level so that the equipment does not run out battery in case of emergency. This may result in a burden on the object person.

DETAILED DESCRIPTION

In general, according to one embodiment, a refrigerator includes an outside environment information obtaining unit including at least one of a sound obtaining unit configured to obtain outside environment information and an imaging unit configured to image an outside environment. The outside environment information obtaining unit is configured to obtain outside environment information which is capable of grasping an outside situation. The refrigerator further includes a communication unit configured to communicate with an external device connected thereto via a network, thereby rendering the outside environment information obtained by the outside environment information obtaining unit referable at the external device side.

A refrigerator according to an embodiment will be described with reference to FIGS. 1 to 9.

Figure 1:
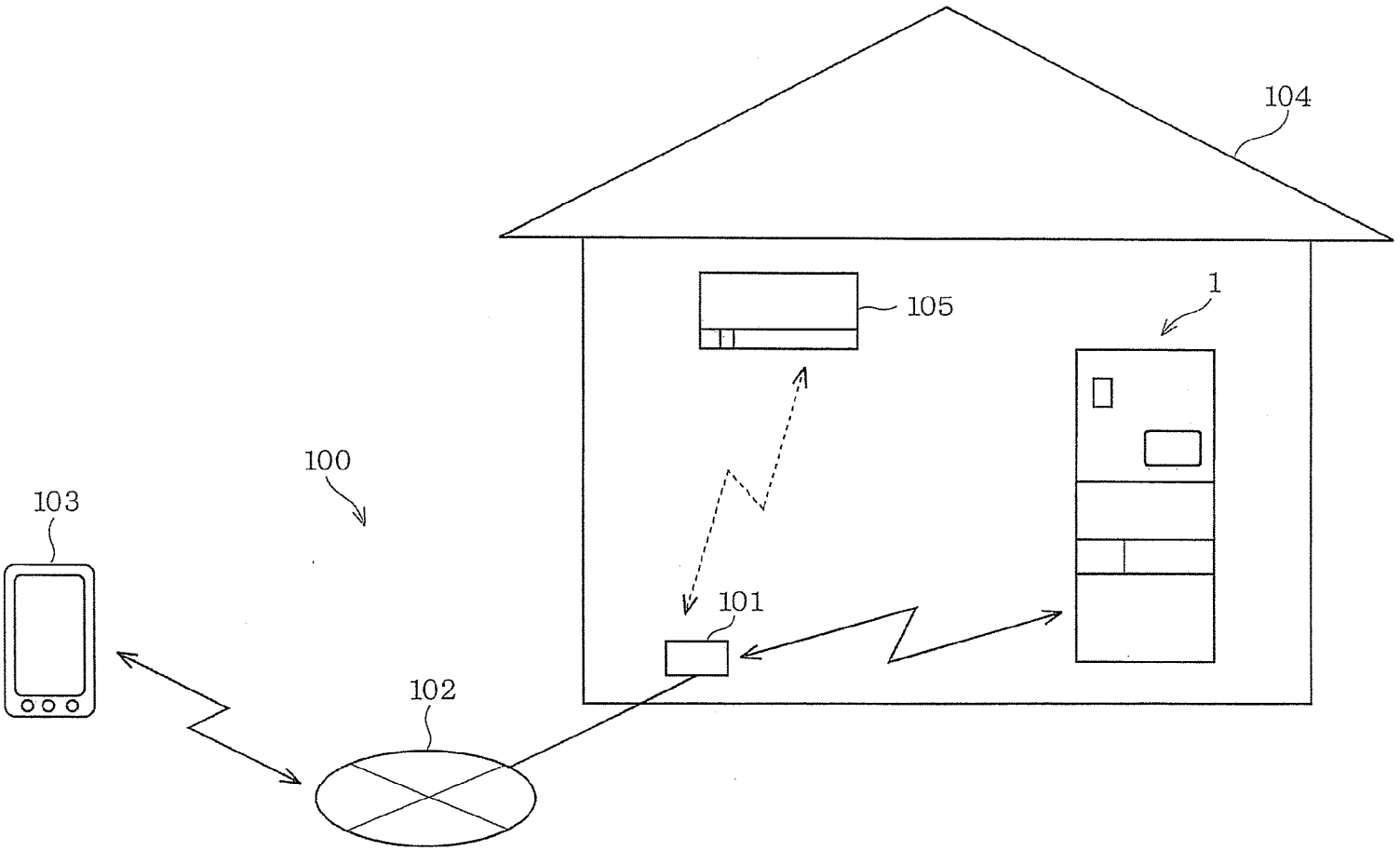
FIG. 1 is a schematic diagram of a watching system employing a refrigerator according to an embodiment.

In a watching system 10 employing the refrigerator 1 according to the embodiment, the refrigerator 1 is communicably connected via a wireless access point 101 and a network 102 to a portable communication terminal 103 serving as an external device, as shown in FIG. 1. The wireless access point 101 is used in the embodiment since the refrigerator 1 employs a wireless communication system as a communication means, as will be described later. However, a communication means of wired system may be employed, instead. In the watching system 100, an air conditioner 105 and other appliances installed in a residence 104 are also connected to the wireless access point 101.

Figure 2:
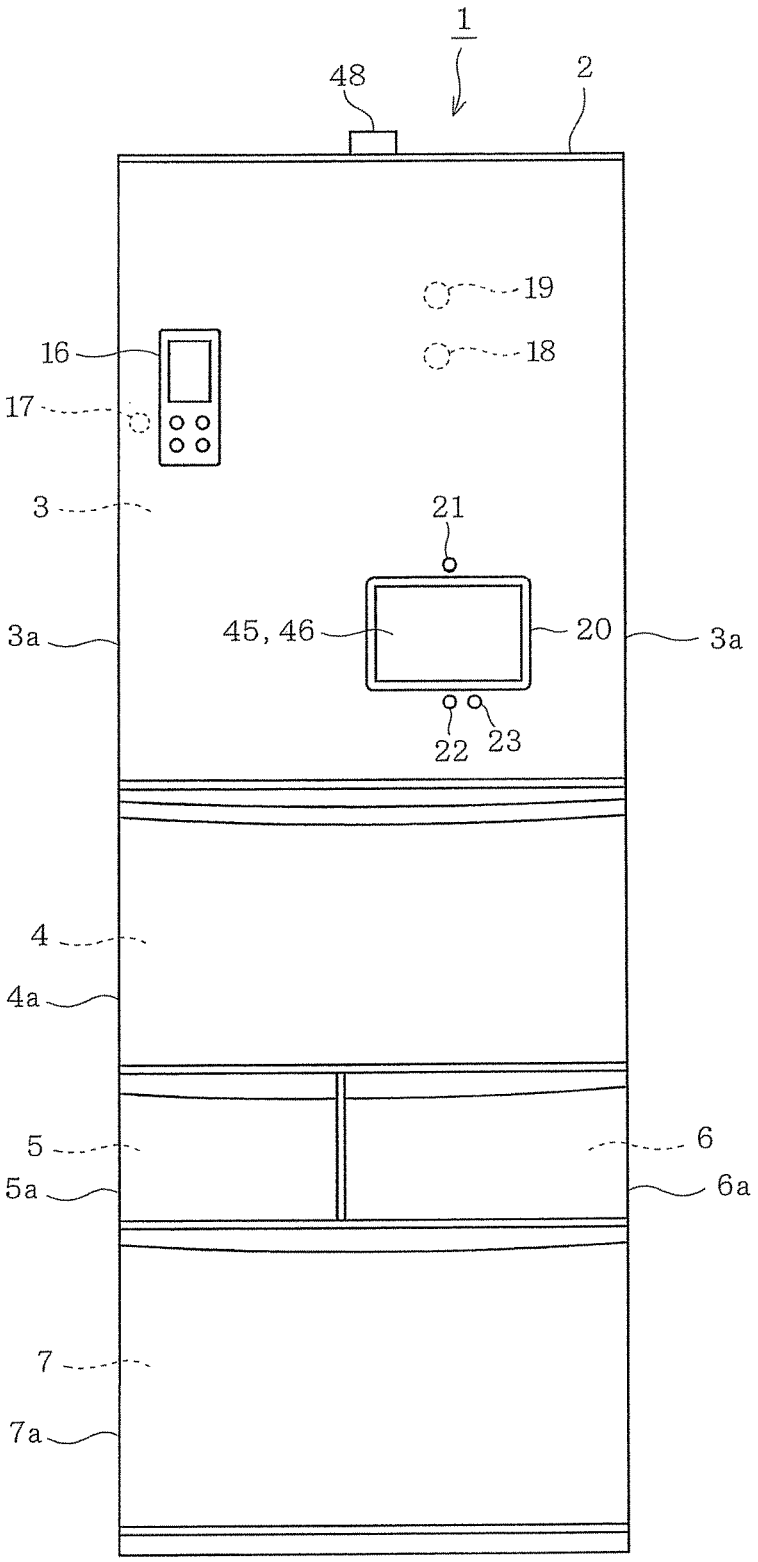
FIG. 2 is a front view of the refrigerator, schematically showing an appearance thereof.
Figure 3:
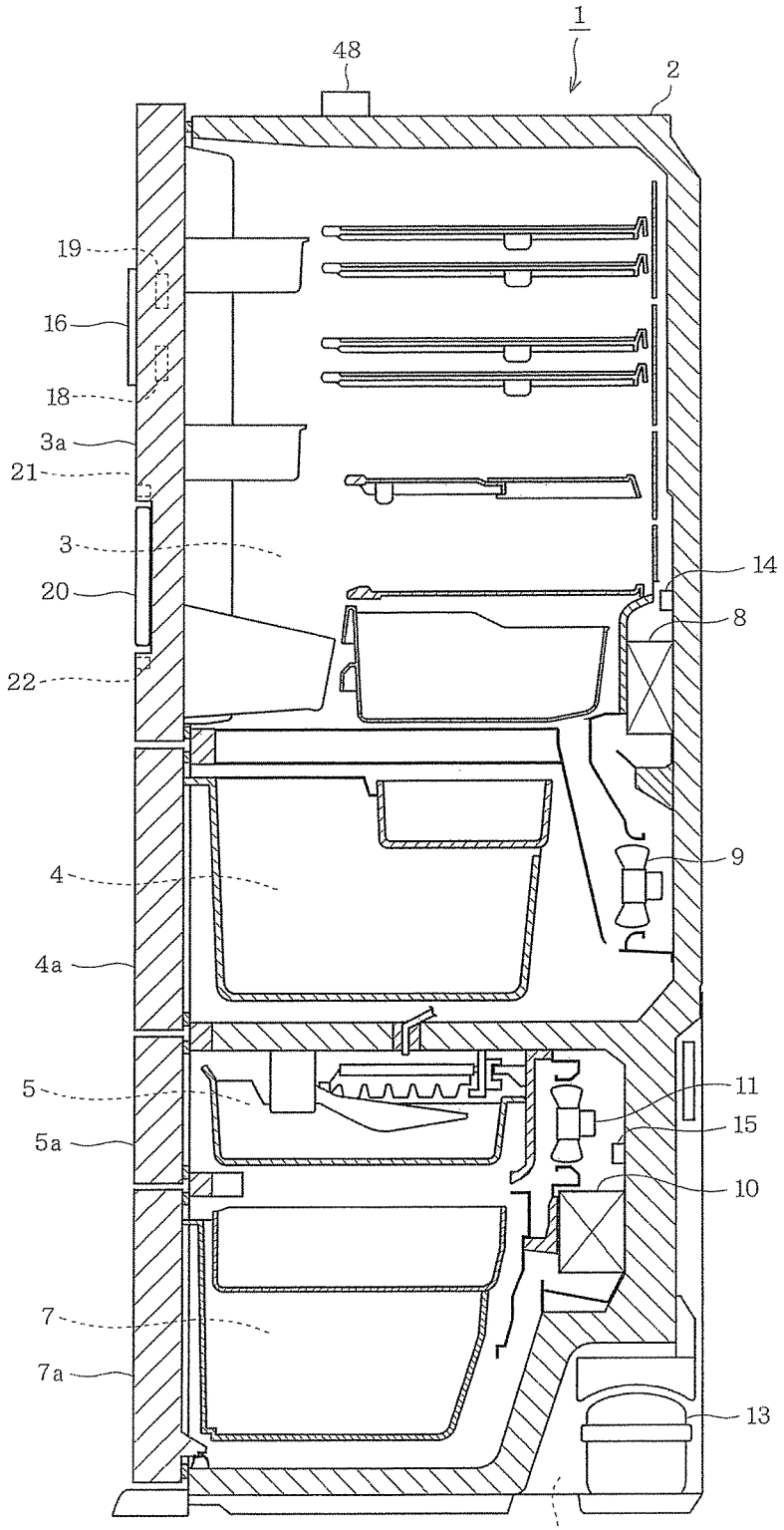
FIG. 3 is a longitudinally sectional side view of the refrigerator, showing the structure thereof.

The refrigerator 1 includes a body 2 having an interior in which are defined a refrigerating compartment 3 serving as a storage compartment for storing food, a vegetable compartment 4, an ice-making compartment 5 and an upper freezing compartment 6, and a lower freezing compartment 7, sequentially from the top, as shown in FIGS. 2 and 3. The refrigerating compartment 3 and the vegetable compartment 4 are separated from the ice-making compartment 5 and the upper freezing compartment 6 by a heat insulation partition wall. The refrigerating compartment 3 is opened and closed by a single swing door 3*a*, and the vegetable compartment 4, the ice-making compartment 5, the upper freezing compartment 6 and the lower freezing compartment 7 are opened and closed by drawer-type doors 4*a*, 5*a*, 6*a* and 7*a* respectively. Each door is provided with a sensor detecting an open/closed state of each door (see FIG. 4; and a refrigerating compartment door sensor 35, a vegetable compartment door sensor 36 and a freezing compartment door sensor 37). The above-described construction of the storage compartments is an example, and an arrangement order of the storage compartments may be changed and for example, the upper freezing compartment 6 may be configured into a switchable compartment switchable between refrigeration and freezing. The refrigerator 1 is installed within a living traffic line or a place which a person necessarily uses when living.

A refrigerating cooler 8 and a refrigerating fan 9 are provided in the rear of the refrigerating compartment 3, as shown in FIG. 3. The refrigerating cooler 8 is provided for the refrigerating compartment 3 and the vegetable compartment 4, and the refrigerating fan 9 is provided for circulating air cooled by the refrigerating cooler 8. Further, a freezing cooler 10 for the upper and lower freezing compartments 6 and 7 is provided in the rear of the ice-making compartment 5. A freezing fan 11 for circulating air cooled by the freezing cooler 10 is also provided in the rear of the ice-making compartment 5. The refrigerating and freezing coolers 8 and 10 are driven by a compressor 13 disposed in a component chamber 12 in the rear of the lower freezing compartment 7. The compressor 13 constitutes a refrigerating cycle together with the refrigerating and freezing coolers 8 and 10 and the like. An operating state of the refrigerating cycle is controlled by a main control 30 (see FIG. 4) according to interior temperatures detected by a refrigerating compartment temperature sensor 14 and a freezing compartment temperature sensor 15.

An operation panel 16 (constituting an operation input unit) including a display and switches are mounted on the door 3*a* of the refrigerating compartment 3, as shown in FIG. 2. The display of the operation panel 16 is configured of a liquid-crystal display or an organic electroluminescence (EL) display, for example and displays various pieces of information regarding the refrigerator 1 using characters, graph and the like. The switches of the operation panel 16 comprise a plurality of switches such as mechanical switches and a touch panel switch. The switches are operated by a person (a resident of the residence 104 in which the refrigerator 1 is installed, that is, an object person of the watching system 100), so that various settings are input to the refrigerator 1.

On the door 3*a* are also mounted an ambient temperature sensor (constituting an outside temperature acquiring unit), a motion detector 19 (constituting a human body detection unit) and an illuminance sensor 18 (constituting an illuminance detection unit).

The ambient temperature sensor 17 includes a temperature detecting device such as a thermistor or an infrared detection device and detects a temperature outside the refrigerator 1, that is, a temperature (hereinafter, "ambient temperature") in a room in which the refrigerator 1 is installed. The motion detector 19 includes a detector which detects infrared ray, visible light, ultrasonic waves or the like (or a combination of detectors detecting infrared ray, visible light, ultrasonic waves and the like) and detects a person located in front of the refrigerator 1. The motion detector 19 may be configured to detect a person when detecting the person continuously for a predetermined time (that is, when detecting a person at a plurality of times) or may be capable of measuring a distance and configured to detect a person when determining that the person is approaching the refrigerator 1. The illuminance sensor 18 comprises a light detection device such as a photoresistor or a photodiode and detects an illuminance outside the refrigerator 1.

On the door 3*a* are further mounted a display terminal 20 (constituting a display unit and an informing unit), an imaging camera 21 (constituting an imaging unit and an outside information obtaining unit), a microphone 22 (constituting a voice acquiring and the outside information acquiring unit) and a loudspeaker 23 (constituting a voice output unit and the informing unit). The display terminal 20 is mounted so that a surface thereof is coplanar with the door 3*a* of the refrigerating compartment 3 or is located slightly inside the door 3*a*. The configuration of the display terminal 20 will be described later.

The imaging camera 21 has an imaging device such as CCD or SMOS and images the outside of the refrigerator 1. The imaging camera 21 is configured to be capable of obtaining both still image and moving image. The imaging camera 21 may provide a color image or a black-and-white image. Both color image and black-and-white image will hereinafter be referred to as "image." The imaging camera 21 is located at a position near a center of the upper side of the display terminal 20 above the display terminal 20, namely, at a position where the imaging camera 21 is capable of imaging the object person straight when he/she is viewing the display terminal 20. The microphone 22 captures sound outside the refrigerator 1, for example, voice uttered by the object person or sound in the room. The loudspeaker 23 outputs audio from the display terminal 20 side.

Figure 4:
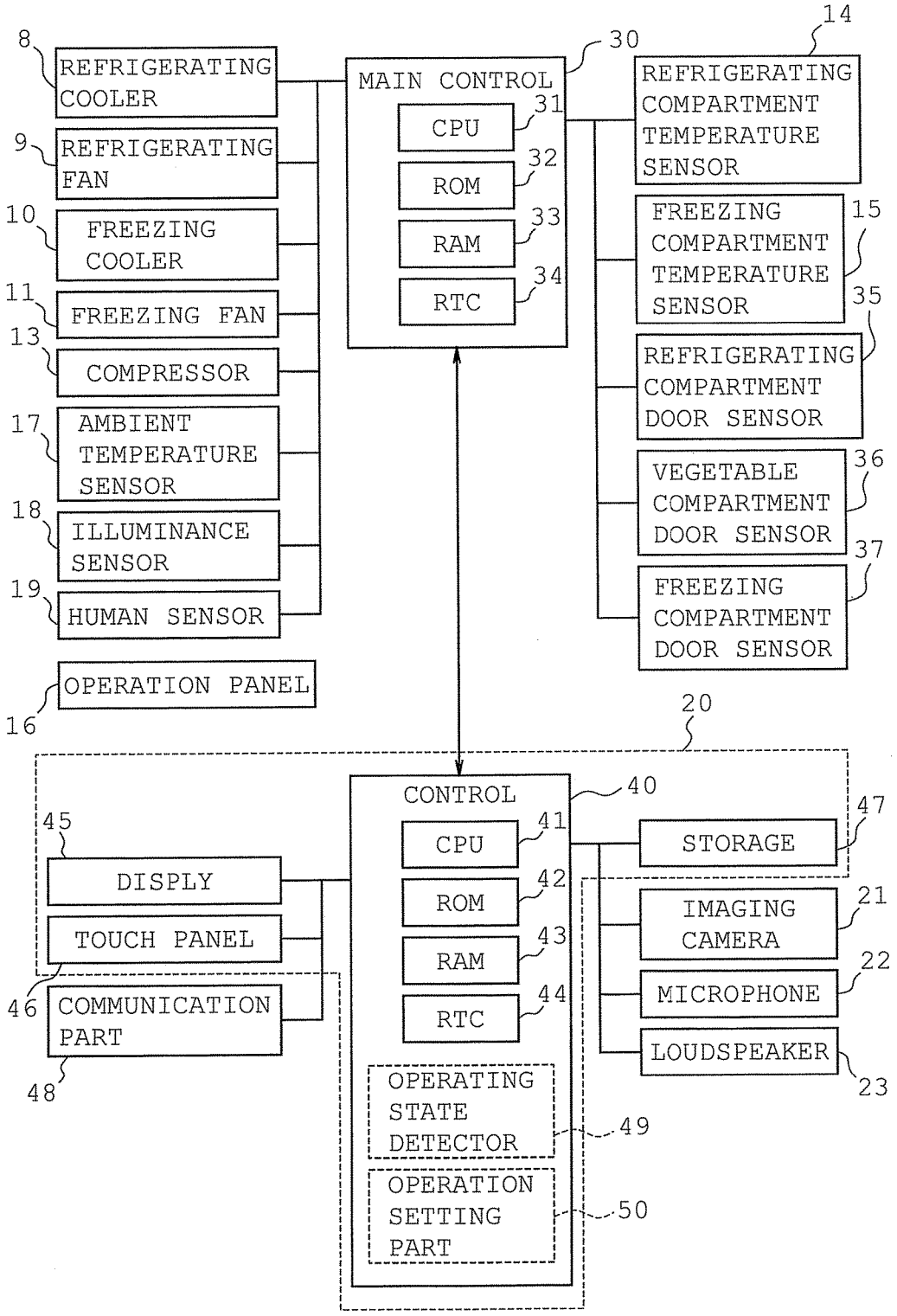
FIG. 4 is a schematic block diagram showing an electrical arrangement of the refrigerator.

The refrigerator 1 having the above-described construction is controlled by the main control 30 as shown in FIG. 4. The main control 30 is configured of a computer having a CPU 31, a ROM 32, a RAM 33 and the like and controls the entire refrigerator 1 according to a computer program stored in the ROM 32, for example. The main control 30 includes a real time clock (hereinafter, "RTC 34") serving as a timing unit and is capable of obtaining time information. The obtainable time information includes time, date and day.

More specifically, the main control 30 controls an operation of the refrigerating cycle (operations of the coolers and fans) according to an ambient temperature measured by the ambient temperature sensor 17, a temperature in the storage compartment detected by the refrigerating compartment temperature sensor 14 or the freezing compartment temperature sensor 15, and the like. The main control 30 further starts an energy-saving operation when there is a low possibility of use of the refrigerator 1, for example, when no person is detected by the motion detector 19, when the time obtained from the RTC 34 indicates late-evening or when the illuminance detected by the illuminance sensor 18 is low (namely, when the lights are turned off in the room).

The main control 30 is further connected to the refrigerating compartment door sensor 35, the vegetable compartment door sensor 36 and the freezing compartment door sensor 37, detecting an open/closed state of these doors 35 to 37. In the embodiment, the freezing compartment door sensor 37 detects an open/closed state of the lower freezing compartment 7. The main control 30 may be configured to detect open/closed states of the ice-making compartment 5 and the upper freezing compartment 6.

The main control 18 is communicably connected to the display terminal 20. The display terminal 20 is controlled by the control 40. The control 40 is configured of a computer having a CPU 41, a ROM 42, a RAM 43 and the like and controls the entire display terminal 20 according to a computer program stored in the ROM 42, for example. The control 40 is further connected to the aforementioned imaging camera 21, the microphone 22, the loudspeaker 23, a display 45 (constituting a display unit), a touch panel 46, a storage 47 (constituting a storage unit) and a communication part 48 (constituting a communication unit).

The display 45 is configured of a liquid-crystal display or an organic EL display, for example and displays various pieces of information at the display terminal 20 side. The touch panel 46 is corresponds to the display 45 and receives operation by the object person. The storage 47 comprises a memory card or a hard disc drive (HDD), for example and stores information (outside information) including images of the object person and images of room interior obtained by the imaging camera 21 and sound obtained by the microphone 22. The storage 47 stores the outside information in correspondence relation with the time information obtained by the RTC 44.

The communication part 48 performs communication with the wireless access point 101 by a wireless communication manner to be capable of transmitting and receiving various pieces of information including outside information through the network 102 to and from a portable communication terminal 103. In the embodiment, the Internet is assumed as the network 102. Further, the portable communication terminal is assumed to be possessed by a member of family of the object person. More specifically, the communication part 48 is capable of referring to the obtained outside information at a remote place. The portable communication terminal 103 serving as the external device may be a tablet personal computer. Any external device which is capable of displaying images and reproducing sound may be employed, for example, a server or a computer of a hospital or a service company providing a watching service.

The control 40 includes an operating state detector 49 (constituting an operating state detection unit) and an operation setting part 50. In the embodiment, the operating state detector 49 and the operation setting part 50 are realized in a software manner by a computer program executed by the control 40. The operating state detector 49 detects a change in an operating state of the refrigerator 1, based on information about the operating state obtained from the main control 30. The information about the operating state includes a rotational speed of the fan, the cooling efficiency of each cooler, and the like. Pieces of information need not be obtained individually but only the fact that the operating state has changed may be obtained as information. The control 40 further obtains information about whether or not a person has been detected, information about open/closed states of the doors, ambient temperature and illuminance, and information about whether or not the operation panel has been operated.

The operation setting part 50 sets obtaining conditions under which outside information is obtained, that is, conditions to drive the imaging camera 21 and the microphone 22. The obtaining conditions will be described in detail later with reference to FIGS. 5 and 6. In the embodiment, the obtaining conditions include cases where the operating state of the refrigerator 1 has changed, the ambient temperature has deviated from a reference temperature range, the illuminance has exceeded a reference illuminance, a person has been detected, one of the doors of the refrigerator 1 has been opened, information about an operation instruction has externally been received, a designated time has come, and a designated time period has elapsed.

The operation setting part 50 further sets values of the above-mentioned reference temperature range (an upper limit and a lower limit of the temperature), the reference illuminance, the designated time and the designated time period and the driving conditions for the imaging camera 21 and the microphone 22 (conditions to set driving states of image and sound). The driving conditions may include, for example, cases where the imaging camera 21 or the microphone 22 is continuously driven (hereinafter, "continuous obtainment" for convenience), driving ends upon lapse of a predetermined time (hereinafter, "temporary obtainment" for convenience), and a momentary still image is obtained (hereinafter, "momentary obtainment" for convenience). Further, the operation setting part is capable of setting which one of the conditions is employed (for example, no outside information is obtained only when a person has been detected; and outside information is obtained when a person has been detected and the door has been operated; and a change in the illuminance is excluded from the obtaining conditions, and the like). Or, the operation setting part is capable of setting a combination of obtaining condition and driving condition (for example, the imaging camera 21 and the microphone 22 are driven when the temperature has exceeded the reference temperature; and only the imaging camera 21 is driven when the temperature has exceeded the reference temperature).

These obtaining conditions, driving conditions, set values and combinations are directly settable on the operation panel 16, the touch panel 46 or the like by the object person, for example and are also remotely-settable from an external device side such as a portable communication terminal 103.

The refrigerator 1 will work as follows.

The refrigerator 1 is used in case of cooking every day since the refrigerator 1 has storage compartments to store food. Accordingly, the refrigerator 1 is installed in a place (a living traffic line) into which the object person substantially normally drops in everyday life. Further, although the refrigerator 1 is configured to perform an energy-saving operation, a plug of the refrigerator 1 is not pulled out so that standby power is eliminated, differing from household appliances such as a television, with the result that the refrigerator 1 is electrically powered at all times. Accordingly, when the refrigerator 1 is configured to be capable of watching the object person, the object person can be observed almost every day, and there would be little possibility of run-out of the battery even when the imaging camera 21 and the communication part 48 are normally operated. More specifically, when the refrigerator 1 is provided with an outside information obtaining unit such as the imaging camera 21, the watching system 100 can be configured without the object person being aware of the system and without becoming a burden on the object person.

Flow of processing to obtain outside information will be described. Although the following processing is executed by the above-described parts, the flow will be described with the refrigerator 1 as a subject for simplification of the description, and the obtaining conditions will be described individually. It is now assumed that the above-described obtaining conditions, driving conditions, setting of the set values have already been carried out.

Figure 5:
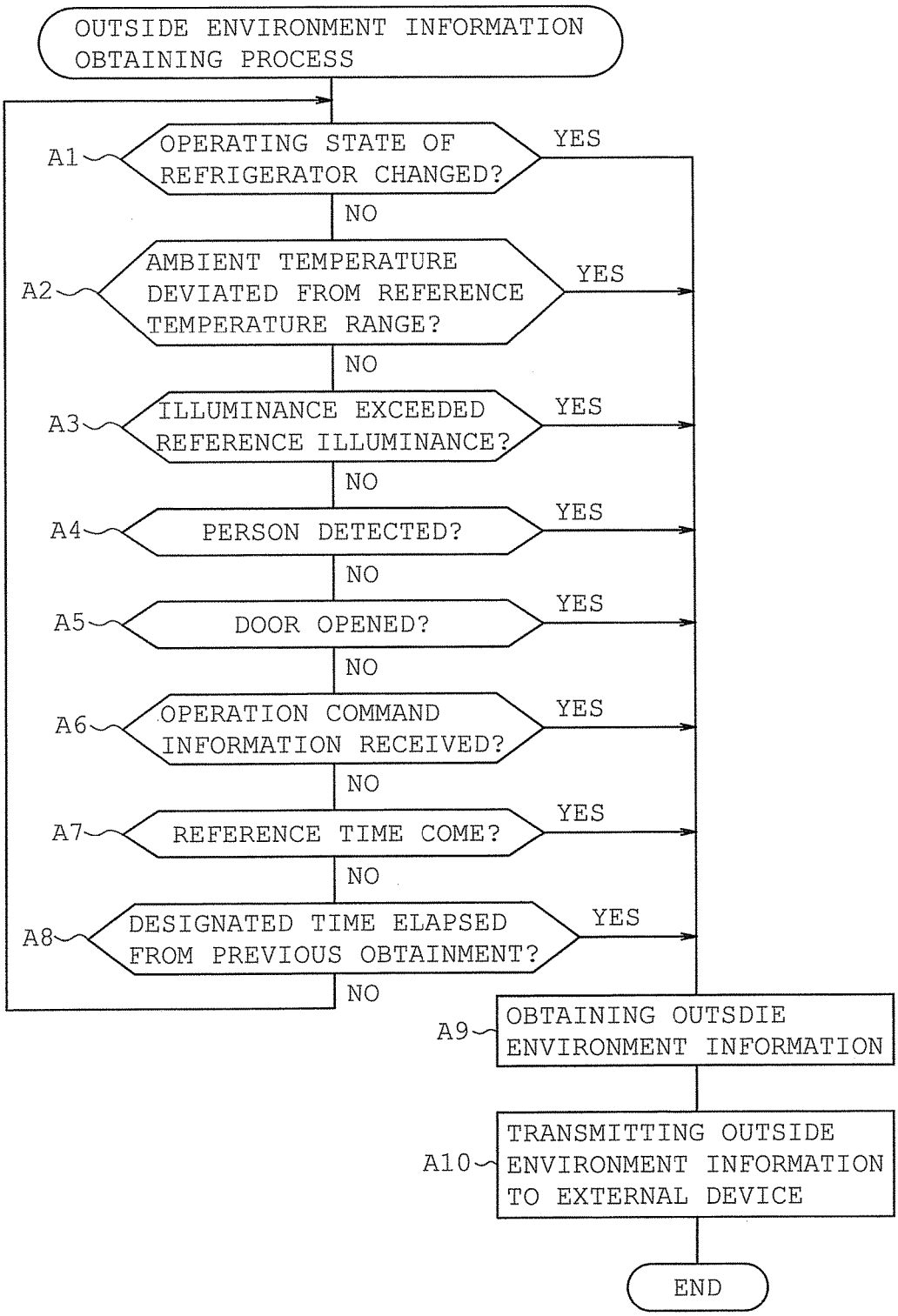
FIG. 5 is a flowchart showing an external information acquisition processing by the refrigerator.

The refrigerator 1 executes an outside information obtaining process as shown in FIG. 5. The refrigerator 1 determines whether or not the operating state thereof has changed (A1), whether or not the ambient temperature has deviated from the reference temperature range (A2), whether or not the illuminance has exceeded the reference illuminance (A3), whether or not a person has been detected (A4), whether or not the door has been operated (A5), whether or not operation command information has been received (A6), whether or not the reference time has come (A7), and whether or not the designated time has elapsed from the previous obtainment (A8). The refrigerator 1 stands by when the determination is negative in each one of the steps (NO at A1; NO at A2; NO at A3; NO at A4; NO at A5; NO at A6; NO at A7; and NO at A8).

When detecting a change in the operating state (YES at A1), the refrigerator 1 obtains outside environment information based on the above-described operating condition (A9). More specifically, the refrigerator 1 obtains outside environment information when any change occurs in the installation environment. The refrigerator 1 then transmits the obtained outside environment information to the external device (the portable communication terminal 103 in the embodiment) (A10), ending the processing. In this case, when the temporary obtainment has been set as the operating condition, for example, the refrigerator 1 obtains outside environment information until a predetermined time elapses from the time of change in the operating condition, thereafter ending the processing.

Further, when the ambient temperature deviates from the reference temperature range or when detecting the ambient temperature having exceeded the upper limit of the reference temperature range, in the embodiment (YES at A2), the refrigerator 1 obtains outside environment information based on the above-described operating condition and the like (A9), transmitting the obtained information to the external device (A10). In this case, for example, it is considered that the upper limit of reference temperature range is set to a temperature which would cause heat stroke and that the continuous obtainment is set as the operating condition and driving both imaging camera 21 and microphone 22 is set as the combination condition. When the conditions are set in this manner, the outside environment information can continuously be obtained and safety of the object person can be confirmed at the remote place side in the case where there is a possibility of occurrence of heat stroke. Outside environment information is also obtained when the temperature is lower than a lower limit of the reference temperature range. As a result, the possibility of hypothermia and the possibility of leading to physical deconditioning due to heat shock or the like can be reduced. Further, the case where the ambient temperature deviates from the reference temperature range (the obtaining condition) includes the case where only the upper limit value has been set and the ambient temperature exceeds the upper limit value (namely, when the reference temperature range is at or below the upper limit temperature) and the case where only the lower limit value has been set and the ambient temperature is at or below the lower limit value (namely, when the reference temperature range is at or above the lower limit value).

When detecting the illuminance exceeding the reference illuminance (YES at A3), the refrigerator 1 obtains outside environment information based on the above-described operating condition (A9), transmitting the obtained information to the external device (A10). In this case, outside environment information upon turn-on of the lighting can be obtained, that is, a person who has turned on the lighting can be confirmed when a reference illuminance is set to an illuminance corresponding to turn-on of the lighting at night and the moment obtainment is set as the driving condition. In this case, the time may be obtained from the RTC 34 or the like and the reference illuminance may be changed between daytime and night-time. Consequently, outside environment information can be prevented from being erroneously obtained in the case where it becomes bright in the room in daytime with the result that the illuminance exceeds the reference illuminance.

When a person is detected (YES at A4), the refrigerator 1 drives the imaging camera 21 and the microphone 22 based on the above-described operating condition to obtain outside environment information (A9), transmitting the obtained information to the external device (A10). In this case, the detection of a person may be carried out by the motion detector 19 or when the operation panel 16 is operated. Consequently, a person near the refrigerator 1 can be confirmed. This can also be used as security measures.

When detecting operation of any one of the doors (YES at A5), the refrigerator 1 obtains outside environment information based on the above-described operating conditions (A9), transmitting the obtained information to the external device (A10). In the embodiment, the refrigerator 1 detects the opening/closing operation when the door 3*a* of the refrigerating compartment 3 is once opened and thereafter closed. The reason for this is that since the imaging camera 21 is mounted on the door 3*a* of the refrigerating compartment 3, there is a possibility that for example, a still image may be distorted when the image is taken while the door 3*a* is open. Accordingly, outside environment information is obtained when the closing of the door 3*a* of the refrigerating compartment 3 is detected. This may not be applied to the obtainment of sound.

When receiving operation command information YES at A6), the refrigerator 1 obtains outside environment information based on the above-described operating conditions (A9), transmitting the obtained information to the external device (A10). The operation command information is transmitted from the external device side. For example, when a user of the portable communication terminal 103 desires to confirm the security of the object person, the user transmits operation command information to drive the imaging camera 21 and the microphone 22 via the portable communication terminal 103 (corresponding to information to execute the operation to obtain outside environment information), and the refrigerator 1 drives the imaging camera 21 and the like when having received the operation command information.

The operation command information should not be limited to the information artificially transmitted by an external person as described above. For example, the operation command information may be such information automatically transmitted by a server connected to the network 102 or the like when predetermined output conditions are met. The output conditions may include a case where weather information is issued regarding a high atmospheric temperature in the location of the residence 104 in which the refrigerator 1 is installed, and a case where disaster information that mudslide has occurred is issued. The output conditions may previously be set artificially, for example, the output conditions may be that the case where the atmospheric temperature exceeds 38° C., or the external device may set the output conditions while comprehensively determining weather conditions, disaster information and the like. In this case, the output conditions may be that the atmospheric temperature is expected to exceed 38° C.

Furthermore, the operation command information includes information that an outside environment information obtaining unit (the imaging camera 21 and the microphone 22) and information that the above-described operating conditions (the continuous obtainment, the temporary obtainment and the moment obtainment) are set.

When determining that the reference time has come (YES at A7), the refrigerator 1 obtains outside environment information based on the above-described operating conditions (A9), transmitting the obtained information to the external device (A10). The reference time is set for the purpose of automatically obtaining outside environment information and is set to, for example, 7 o'clock every morning. In this case, since human lifestyle pattern generally tends to be almost similar daily, setting a mealtime of the object person to the reference time is more effective. The reference time may be set so as to include day or date as well as time or a plurality of times, for example, 7 am, 12 pm and 7 pm.

When determining that the designated time has elapsed (YES at A8), the refrigerator 1 obtains outside environment information based on the above-described operating conditions (A9), transmitting the obtained information to the external device (A10). The designated time refers to a time interval set to automatically obtain outside environment information, for example, intervals f one hour. The refrigerator 1 repeatedly obtains outside environment information at set time intervals, transmitting the obtained information to the external device. Consequently, the safety of a child or infant staying alone in the residence can periodically be confirmed, for example.

Thus, the refrigerator 1 obtains outside environment information whereby the situation at the refrigerator 1 side can be understood and transmits the obtained information to the external device such as the portable communication terminal 103 and/or the like. As a result, the situation at the refrigerator 1 side can be understood, that is, the object person can be watched at a remote place.

For example, the object person is sometimes absent near the refrigerator 1 when outside environment information is obtained at the above-mentioned reference time or at intervals of predetermined time. Further, even when operation command information is transmitted from the external device, the object person sometimes happens to be absent near the refrigerator 1. In view of these cases, the refrigerator 1 stores outside environment information obtained in the past, and the stored past outside environmental information referable as the history at the external device side.

Figure 6:
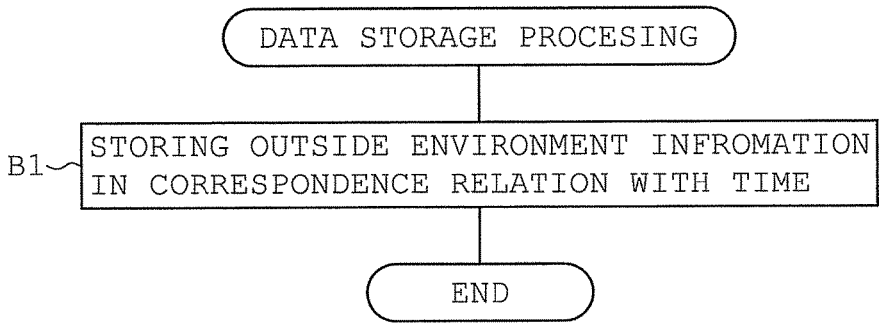
FIG. 6 is a flowchart showing storage processing by the refrigerator.

The refrigerator 1 executes data storage processing as shown in FIG. 6 and stores obtained outside environment information in the storage 47 in a correspondence relation with the time information obtained by the RTC 44 or the like (B1). The outside environment information may be stored every time when obtained. However, when outside environmental information obtained in the continuous obtainment mode is referred to at the external device side in real time, the information sometimes need not be stored. Accordingly, storing conditions combined with the obtaining conditions of the outside environment information may be set. Outside environment information may be stored when the storing conditions are met. For example, outside environment information may be stored when the outside environment information is obtained at a designated time or when the outside environment information is obtained at intervals of a predetermined time period. In the embodiment, outside environment information is not stored in the case of continuous obtainment.

Figure 7:
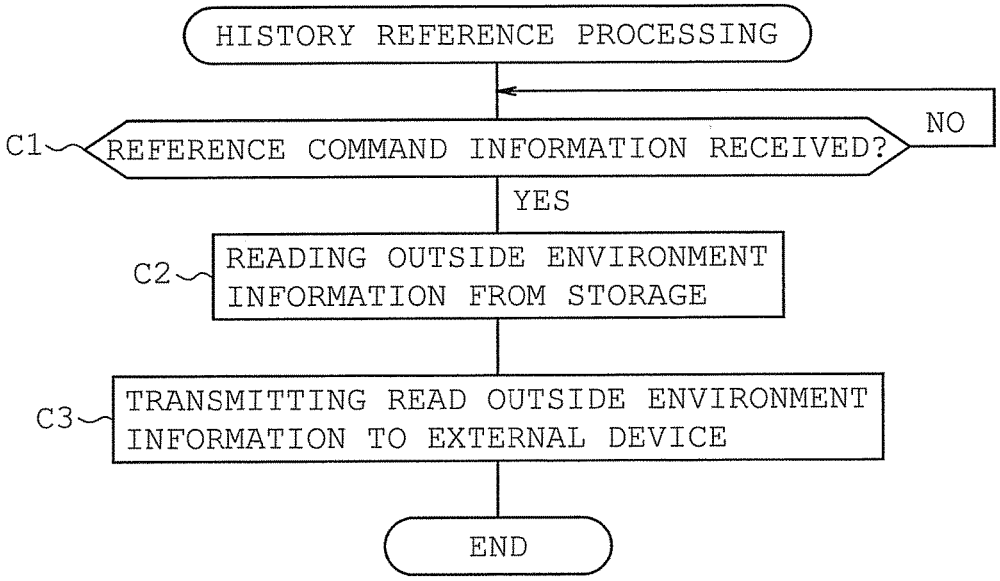
FIG. 7 is a flowchart showing history reference processing by the refrigerator.

The refrigerator 1 executes history reference processing as shown in FIG. 7, determining whether or not reference command information has been received (C1). The reference command information is command information output at the external device side and is used to refer to outside environment information stored by the refrigerator 1. The reference command information includes information about the time the outside environment information to be referred to was obtained and information about which one of an image and sound is referred to, and the like. When receiving reference command information (YES at C1), the refrigerator 1 reads outside environment information as a target from the storage 47 (C2), transmitting the read outside environment information to the external device (C3).

As a result, the external device can refer to the past outside environment information as history.

The object person can be watched using the refrigerator 1 as described above. However, in order that the object person may be watched, it is desirable that the external device side is also capable of providing information so that one-way surveillance can be prevented. In view of this, the refrigerator 1 realizes provision of information by the external device side in the following manner.

Figure 8:
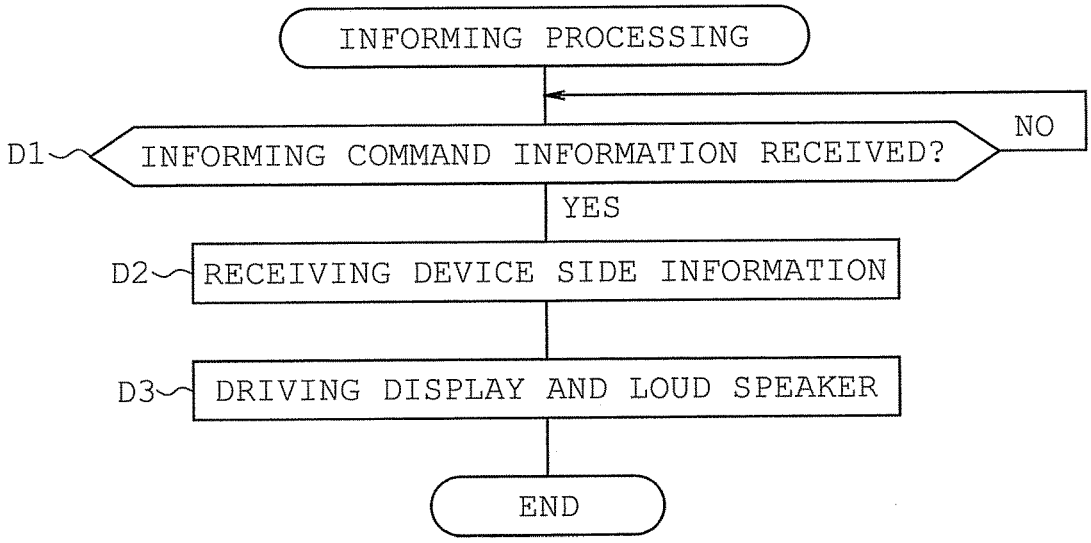
FIG. 8 is a flowchart showing informing processing by the refrigerator.

The refrigerator 1 executes informing processing as shown in FIG. 8 and determines whether or not informing command information has been received (D1). The informing command information is provided for informing (display output or sound output), at the refrigerator 1 side, device side information including at least one of sound at the external device side and an image of the external device side. The informing command information may include instructions which have a high degree of urgency and are to be immediately informed and instructions, such as regular communication, which have a low degree of urgency and are received to be informed later, depending upon the content of device side information.

When receiving informing command information (YES at D1), the refrigerator 1 further receives device side information to be informed (D2). Sound and image are assumed as the device side information in the embodiment. Accordingly, when receiving device side information at step D2, the refrigerator 1 drives the display 45 and the loudspeaker 23 (D3), outputting the image and the sound contained in the device side information.

As a result, the object person at the refrigerator 1 side can receive the information provided from the external device side.

The refrigerator 1 can grasp the situation at the refrigerator 1 and inform the information supplied from the external device side to the refrigerator 1 side. However, when watching is taken into consideration, it is important to communicate directly between the refrigerator 1 side and the external device side. Further, there is sometimes a case where the object person desires to provide to the external device side information such as that the object person is in bad physical condition. In view of this, the refrigerator 1 can perform interactive communication.

Figure 9:
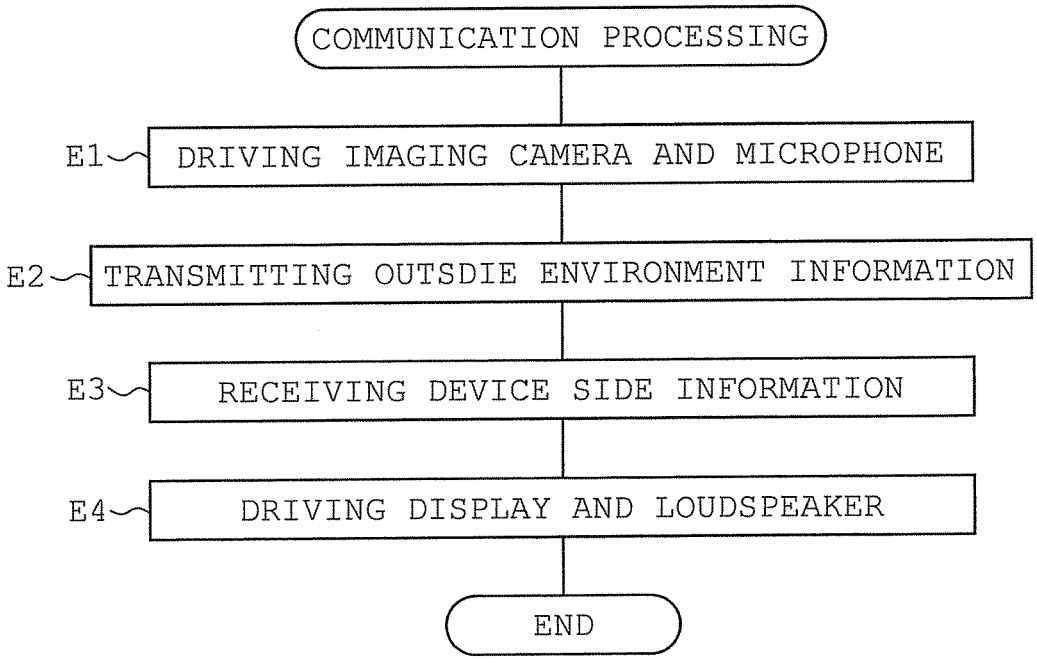
FIG. 9 is a flowchart showing communication processing by the refrigerator.

The refrigerator 1 executes communication processing as shown in FIG. 9. When an operation instruction is supplied from the object person, the refrigerator 1 drives the imaging camera 21 and the microphone 22 (E1) and transmits outside environment information, namely, an image of the face and voice of the object person to the external device (E2). The external device obtains and transmits device side information for response based on the transmitted outside environment information. When receiving the device side information (E3), the refrigerator 1 drives the display 45 and the loudspeaker 23 (E4), outputting the device side information. Subsequently, communication is performed between the object person and the external device side. The refrigerator 1 ends the processing upon finish of the communication.

Thus, the refrigerator 1 can provide real-time communication between the refrigerator 1 side and the external device side located at the remote place. The communication instruction can also be transmitted from the external device side as well as from the refrigerator 1 side, so that the refrigerator starts the communication processing upon receipt of the instruction.

The refrigerator 1 of the embodiment as described above can achieve the following advantageous effects. The refrigerator 1 which is installed within the living traffic line and used every day is provided with the outside environment information obtaining unit such as the imaging camera 21. Accordingly, the watching system 100 can watch the object person even if the object person does not carry out an action unnecessary in everyday life, such as consciously standing in front of a camera.

Since the refrigerator 1 is normally powered at all times, power to drive the imaging camera 21, the communication part 48 and the like can be ensured easily with the result that there is almost no possibility of run-out of battery. Accordingly, the object person is free from burden such as confirmation of the battery.

The operation setting part 50 is capable of setting the obtaining condition of the outside environment information, the driving condition of the outside environment information obtaining unit, the combination of the obtaining and driving conditions or the like. This can reduce the possibility of obtaining outside environment information on an unnecessary occasion. Further, since the timing of obtaining outside environment information is settable, the outside environment information can be obtained with consideration of the privacy of the object person.

The refrigerator 1 obtains the outside environment information when detecting a change in the operating state, namely, when the installation environment of the refrigerator 1 has changed. Thus, the refrigerator 1 can obtain the outside environment information properly and timely depending on a situation.

The refrigerator 1 obtains the outside environment information when detecting deviation of the ambient temperature from the reference temperature range. Accordingly, the refrigerator 1 can respond to a case where the ambient temperature is high so that the object person may get heat stroke, for example and a case where the ambient temperature is low so that the object person may be subjected to heat shock or the like.

The refrigerator 1 obtains the outside environment information when detecting the illuminance exceeding the reference illuminance. This can specify turn-on of the lighting, namely, presence of a person and reduce the possibility of obtaining outside environment information on an unnecessary occasion. Further, since the reference illuminance is set to the illuminance obtained during turn-on of the lighting, imaging can reliably be carried out, and a person who has turned on the lighting can be confirmed.

Since the refrigerator 1 obtains the outside environment information when detecting a person, outside environment information can be obtained even when the refrigerator 1 is not directly used. Accordingly, the refrigerator 1 can be used for security. This can be applied to a case where outside environment information is obtained by imaging at the above-mentioned illuminance.

Since outside environment information is obtained when operation of the door is detected, a person using the refrigerator 1 can reliably be imaged. Further, since outside environment information is obtained when the closure of the door 3*a* of the refrigerating compartment 3 is detected, an image can be prevented from being distorted.

Since the refrigerator 1 obtains outside environment information when receiving the operation command information, the refrigerator 1 can respond to a case where the object person needs to be confirmed at the external device side, and the like. Further, the refrigerator 1 is configured to respond to operating command information issued by an outsider and operating command information automatically transmitted by a server connected to the network, or the like. Accordingly, the refrigerator 1 can cope with various situations.

The refrigerator 1 obtains outside environment information when determining that the reference time has come. Accordingly, since human lifestyle pattern generally tends to be almost similar daily, for example, the outside environment information can be obtained at the mealtime of the object person or the like with the result that the object person can efficiently be watched.

The refrigerator 1 obtains outside environment information when determining that the designated time has elapsed. Accordingly, the refrigerator 1 can respond to a user who desires to refer to outside environment information periodically.

Since outside environment information obtained in the past is stored and can be referred to as history at the external device side, the refrigerator 1 can cope with various situations including an inquiry as to how the object person was in the morning.

Since information can also be provided from the external device side, one-way surveillance can be prevented and the refrigerator 1 can be expanded to functions other than the watching function, for example, a function of calling for the object person or advising the object person based on outside environment information.

Since the refrigerator 1 can communicated with the external device side, a person at the external device side can talk directly to the object person while viewing the face of the object person. In this case, since the imaging camera 21 is mounted at the position near the center of the upper side of the display terminal 20 above the display terminal 20, the object person can communicate with the person at the external device side while facing the front so that an image of the face can be viewed at the external device side.

Other Embodiments

The positions, the number or mounting manners of the sensors and the like should not be limited as those described in the foregoing embodiment. For example, the direction of the imaging camera 21 may be variable or a wide-angle lens may be used so that an entire room can be imaged, or a plurality of imaging cameras 21 may be provided.

Although the main control 30 and the control 40 are provided in the foregoing embodiment, either one of the two may be provided, and the processing may be performed by a single control unit.

Although the opening/closing operation is detected when the door 3*a* of the refrigerating compartment 3 is closed, for example, outside environment information may be obtained when the refrigerator 1 detects the opening of the door other than the door 3*a* of the refrigerating compartment 3. Further, in the case where the refrigerator 1 is configured so that the imaging camera 21 is provided in the interior of the refrigerating compartment 3, outside environment information may be obtained when an open state of the door 3*a* of the refrigerating compartment 3 is detected. Further, outside environment information may be obtained when the contact with the door of the refrigerating compartment is detected. When the door is opened by an actuator or the like, for example, the open/closed state of the door may be detected on the basis of actuation of the actuator.

Although outside environment information is obtained based on the individual obtaining condition in the embodiment, the obtaining conditions may be combined. For example, the following combinations are considered. A person is detected and outside environment information is obtained for a predetermined time period; the reference time and the designated time period are combined, and outside environment information is obtained at intervals of a predetermined time period from the reference time; and operation command information is received and outside environment information is obtained at intervals of a predetermined time period from receipt of operation command information. More specifically, the combination of obtaining condition and driving condition in not limited to that exemplified in the foregoing embodiment.

Although a person is detected by the motion detector 19 in the embodiment, the configuration that a person is detected when the operation panel 16 is operated, that is, the configuration that the operation panel 16 is used as a person detection unit may be employed.

Although the obtained outside environment information is stored in the storage 47 in the foregoing embodiment, a server or the like may be provided as an external device and outside environment information is stored in the server side storage (constituting an external storage unit). More specifically, the refrigerator 1 can use the external device side storage to store outside environment information as well as the refrigerator 1 side storage 47. In this case, storages may be provided at both sides respectively. However, the storage is preferably provided at the server side since an upper limit of storage capacity and the like need not be taken into consideration and the manufacturing costs can be reduced.

In this case, for example, the portable communication terminal 103 can refer to the past outside environment information when reference command information is output to the server.

Outside environment information is obtained based on the operation instruction data transmitted from the external device in the foregoing embodiment. However, when risk of heat stroke, heat shock or the like can be expected from the detected ambient temperature, outside environment information may be obtained and transmitted to the external device or the informing processing may be executed on the basis of determination at the refrigerator 1.

The refrigerator 1 may be configured to output a drive command to drive an air conditioner 105 for a cooling operation when the received operation command information includes weather information indicative of high atmospheric temperature, for example and risk of heat stroke or the like can be expected. In this case, it is better that informing command information is firstly transmitted and the air conditioner 105 or the like is driven when no response is received. As a result, the possibility of debilitation of the object person can be reduced in the situation where the temperature is high and the object person cannot move. On the other hand, when the operation command information includes weather information indicative of low atmospheric temperature and risk of heat shock or the like can be expected, a drive command to drive the air conditioner 105 for the warming operation may be output from the refrigerator 1.

Figure 10:
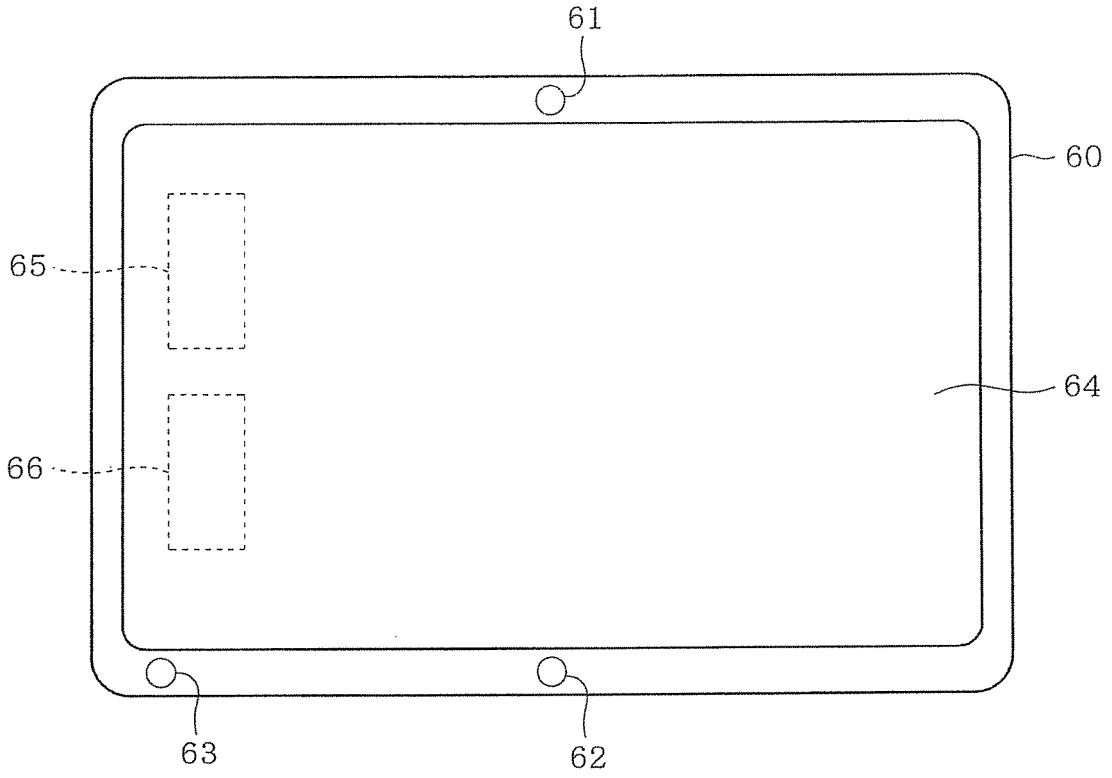
FIG. 10 schematically illustrates a portable communication terminal by a refrigerator according to another embodiment.

A portable communication terminal 60 may be employed as the external device as shown in FIG. 10. The portable communication terminal 60 includes a terminal side camera 61 (constituting the outside environment information obtaining unit) serving as a terminal side imaging unit, a terminal side microphone 62 (constituting the outside environment information obtaining unit) serving as a terminal side sound obtaining unit, a terminal side loudspeaker 63 (constituting a terminal side informing unit) serving as a terminal side sound output unit, a terminal side display 64 (constituting a terminal side informing unit and a terminal side operation input unit) configured in the same manner as the display 45 and the touch panel 46 as shown in FIG. 3, a terminal side control 65 (constituting an operation state detection unit) performing the same processing as the control 40 and a terminal side communication part 66 (constituting a terminal side communication unit) communicable with the external network 102 without the wireless access point 101.

The portable communication terminal 60 is detachably attachable to the door 3*a* of the refrigerator 3 normally. Accordingly, when detached from the door 3*a*, the portable communication terminal 60 can be carried to a visiting place. The portable communication terminal 60 includes a short-distance communication unit which communicates with the refrigerator 1 by near field communication such as Bluetooth (registered trademark) or by cable communication such as USB standard.

The portable communication terminal 60 communicates with the refrigerator 1 via the network 102 at a visiting place, so that outside environment information is obtained by the outside environment information obtaining unit at the refrigerator 1 side, and the obtained outside environment information is informed by the terminal side display 64. More specifically, the portable communication terminal 60 such as a tablet personal computer, a smartphone or a mobile phone can be employed as the display terminal 20 as shown in FIG. 2 and the like.

Further, the operation command information may be entered from the touch panel provided on the terminal side display 64 of the portable communication terminal 60, or the like, so that outside environment information is obtained at a visiting place. As a result, the safety of a child or an infant staying alone in the residence can periodically be confirmed.

Further, the outside environment may be imaged by the terminal side camera 61 and outside sound may be collected by the terminal side microphone 62, instead of providing the outside environment information obtaining part in the refrigerator 1 as in the foregoing embodiment. In this case, outside environment information and external information may be informed by the terminal side display 64. The portable communication terminal 60 is generally driven by a battery. Even if power supply to the refrigerator 1 is stopped by occurrence of electric power failure or the like, the portable communication terminal 60 can be driven for a certain amount of time by the battery. Further, the portable communication terminal 60 is connectable to the network 102 alone as described above. Accordingly, even when a disaster or the like causes an electric power failure, watching and encouragement can be carried out by informing outside environment information by the portable communication terminal 60.

In this case, when the portable communication terminal 60 is mounted on the refrigerator 1, it is desirable to render the portable communication terminal 60 chargeable from the refrigerator 1. As a result, the possibility of run-out of battery can be reduced, and the need for charging may not be carried out, with the result that the burden on the user can be reduced. Further, the portable communication terminal 60 is frequently placed on the refrigerator 1 by rendering the portable communication terminal 60 chargeable from the refrigerator 1, with the result that the watching system can always be operable.

Although the wireless access point 101 is provided individually in the foregoing embodiment, the wireless access point 101 may be integrated with the refrigerator 1. The access point can be prevented from being erroneously powered off by providing the refrigerator 1 powered at all times with a function of the access point. More specifically, the refrigerator 1 may be provided with a function of the access point of home networking.

Further, when the above-described portable communication terminal 60 is provided, the portable communication terminal 60 may be used as the access point. In this case, the refrigerator 1 may have a function of connecting to portable communication network such as a third generation (3G) communication function directly connectable to the network 102 or a function of connecting to a wide-area wireless LAN (such as WiMAX (registered trademark). More specifically, a communication unit provided in the refrigerator 1 includes a communication function directly connectable to the external network 102 as well as the function of communication with the wireless access point 101 as presented in the foregoing embodiment.

The refrigerator 1 may be provided with an auxiliary power supply such as an uninterruptible power-supply system. As a result, watching, addressing and the like can be carried out even when a disaster or the like causes an electric power failure. In this case, when the refrigerator 1 is provided with a function of access point and a communication function directly connectable to the external network 102, the refrigerator 1 can be connected to the network 102 during electric power failure. Further, when the portable communication terminal 60 is used as the access point, watching and addressing can be carried out even in the case where the wireless access point 101 is disconnected from the network. The auxiliary power supply need not be provided together with the refrigerator 1 but may commonly be used by the refrigerator 1 and a plurality of other household electrical appliances. Further, the auxiliary power supply may be configured to supply electrical power only to the function of obtaining outside environment information without power supply to the refrigerating function of the refrigerator 1. More specifically, the auxiliary power supply may be configured for the purpose of maintaining the watching system.

According to the embodiment, the refrigerator includes the outside environment information obtaining unit and the communication unit which can render the outside environment information referable at the external device side. As a result, the object person can be watched by the refrigerator used every day without an action unnecessary in ordinary life, such as consciously standing in front of a camera. Further, since the refrigerator is electrically powered basically, power to drive the outside environment information obtaining unit can easily be ensured, and there is little possibility of run-out of the battery, with the result that a burden such as confirmation of the battery can be prevented from being imposed on the object person.

The foregoing embodiments may be combined together. While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A refrigerator comprising:

at least one processor configured to detect a change in an operating state of a cooling operation of the refrigerator caused by a change in an installation environment of the refrigerator at a time when no user is operating the refrigerator;

at least one sensor including at least one of a microphone configured to obtain sound from an outside of the refrigerator in a room in which the refrigerator is installed in response to the at least one processor detecting the change in the operating state of the cooling operation of the refrigerator and a camera configured to obtain an image of the outside of the refrigerator in a room in which the refrigerator is installed in response to the at least one processor detecting the change in the operating state of the cooling operation of the refrigerator; and a transceiver configured to communicate with an external device via a network, thereby transmitting outside environment information including the at least one of the sound and the image obtained by the at least one sensor to the external device, thereby causing the external device to display, by a display, the image and reproduce, by a loudspeaker, the sound from the outside environment information transmitted from the refrigerator.

2. The refrigerator according to claim 1, wherein the at least one processor is configured to detect an opening and/or closing operation of a door of a storage compartment provided in the refrigerator, wherein the at least one sensor is configured to obtain the outside environment information in response to the opening/closing operation of the door being detected by the at least one processor.

3. The refrigerator according to claim 1, further comprising an outside temperature sensor configured to detect an outside temperature, wherein the at least one sensor is configured to obtain the outside environment information in response to the outside temperature obtained by the outside temperature sensor deviating from a set reference temperature range.

4. The refrigerator according to claim 1, further comprising an operation panel configured to input settings to the refrigerator, wherein the at least one sensor is configured to obtain the outside environment information in response to the setting operation being input from the operation panel.

5. The refrigerator according to claim 1, further comprising a motion sensor configured to detect a human body present near the refrigerator, wherein the at least one sensor is configured to obtain the outside environment information in response to a human body being detected by the motion sensor.

6. The refrigerator according to claim 1, wherein the at least one sensor is configured to obtain the outside environment information at intervals of a predetermined time.

7. The refrigerator according to claim 1, further comprising an illuminance sensor configured to detect an illuminance in an environment outside the refrigerator, wherein the at least one sensor is configured to obtain the outside environment information in response to the illuminance detected by the illuminance sensor exceeding a predetermined reference illuminance.

8. The refrigerator according to claim 1, wherein the transceiver is configured to receive operation command information transmitted from the external device side and to cause the at least one sensor to obtain the outside environment information, wherein the at least one sensor is configured to obtain the outside environment information in response to the operation command information being received by the transceiver.

9. The refrigerator according to claim 8, wherein the operation command information includes an operation command a user of the external device artificially carries out.

10. The refrigerator according to claim 8, wherein the operation command information includes an operation command the external device automatically outputs in response to a predetermined output condition being met.

11. The refrigerator according to claim 1, wherein:

the transceiver is configured to receive operation setting information transmitted from the external device side and to set an operating condition including at least a time at which the at least one sensor obtains the outside environment information; and the at least one sensor is configured to obtain the outside environment information in response to the operating condition set by the operation setting information received by the transceiver being met.

12. The refrigerator according to claim 1, further comprising a storage configured to store the outside environment information obtained by the at least one sensor, wherein the transceiver is configured to communicate the outside environment information stored in the storage to the external device and receive external information from the external device and store the external information in the storage.

13. The refrigerator according to claim 12, wherein the storage includes an external storage connected to the network.

14. The refrigerator according to claim 1, wherein the transceiver is configured to:

receive device side information obtained by at least one device side sensor provided at an external device side, the device side information including sound obtained by the at least one device side sensor and an image obtained by the at least one device side sensor, the device side information being information describing a situation at the external device side, the refrigerator further comprising at least one of a refrigerator side loudspeaker configured to output a sound obtained by the at least one device side sensor and a refrigerator side display configured to display the image obtained by the at least one device side sensor.

15. The refrigerator according to claim 14, wherein:

the transceiver is configured to receive informing command information transmitted from the external device side, the informing command information including information configured to affect operation of the at least one of the refrigerator side loudspeaker and the refrigerator side display; and the at least one of the refrigerator side loudspeaker and the refrigerator side display is configured to inform the device side information in response to the informing command information being received by the transceiver.

16. The refrigerator according to claim 14, wherein the camera is provided on a central part of an upper front of the refrigerator side display.

17. A watching system comprising:

a refrigerator comprising:

at least one processor configured to detect a change in an operating state of a cooling operation of the refrigerator caused by a change in an installation environment of the refrigerator at a time when no user is operating the refrigerator;

at least one sensor including at least one of a microphone configured to obtain sound from an outside of the refrigerator in a room in which the refrigerator is installed in response to the at least one processor detecting the change in the operating state of the cooling operation of the refrigerator and a camera configured to obtain an image of the outside of the refrigerator in a room in which the refrigerator is installed in response to the at least one processor detecting the change in the operating state of the cooling operation of the refrigerator; and a transceiver configured to transmit outside environment information including the at least one of the sound and the image obtained by the at least one sensor; and an external device connected to the refrigerator via a network, the external device comprising at least one of a display configured to display the image and a loudspeaker configured to reproduce the sound from the outside environment information transmitted from the refrigerator.

* * * * *